US005954592A

United States Patent [19]

Laffer et al.

[11] Patent Number: 5,954,592

[45] Date of Patent: Sep. 21, 1999

[54] GOLF SWING TRAINING SYSTEM

[76] Inventors: Michael R. Laffer, 5410 Putnam, West Bloomfield; Trevor C. Parkinson, 1576 Gas Light Ln., Rochester Hills, both of Mich. 48306

[21] Appl. No.: 09/096,897

[22] Filed: Jun. 12, 1998

[51] Int. Cl.[6] ..... A63B 69/36

[52] U.S. Cl. ..... 473/220; 473/278

[58] Field of Search ..... 473/220, 278

[56] References Cited

U.S. PATENT DOCUMENTS

| | | | |
|---|---|---|---|
| 2,707,638 | 5/1955 | Manley | 473/218 |
| 3,868,109 | 2/1975 | Fowler | 473/218 |
| 3,953,034 | 4/1976 | Nelson . | |
| 4,693,479 | 9/1987 | McGwire . | |
| 4,913,441 | 4/1990 | Freer . | |
| 5,139,263 | 8/1992 | Feo | 473/257 X |
| 5,154,427 | 10/1992 | Harlan et al. . | |
| 5,435,562 | 7/1995 | Stock et al. . | |
| 5,467,991 | 11/1995 | White, IV et al. . | |
| 5,593,354 | 1/1997 | Falossi et al. . | |
| 5,655,973 | 8/1997 | McPherson, Jr. . | |
| 5,665,006 | 9/1997 | Pellegrini . | |
| 5,685,782 | 11/1997 | Lipps et al. . | |
| 5,759,110 | 6/1998 | Serbel et al. | 473/220 |

*Primary Examiner*—George J. Marlo
*Attorney, Agent, or Firm*—Harness, Dickey & Pierce, P.L.C.

[57] ABSTRACT

A golf swing training system is provided including a light source such as a laser light that generates a light beam from the grip end of a golf club and a mat having disposed thereon graphics depicting a preferred light beam path. Upon swinging the golf club such that the light beam projects upon the mat following the light beam path golfers are taught how to swing the club along a preferred swing plane.

17 Claims, 5 Drawing Sheets

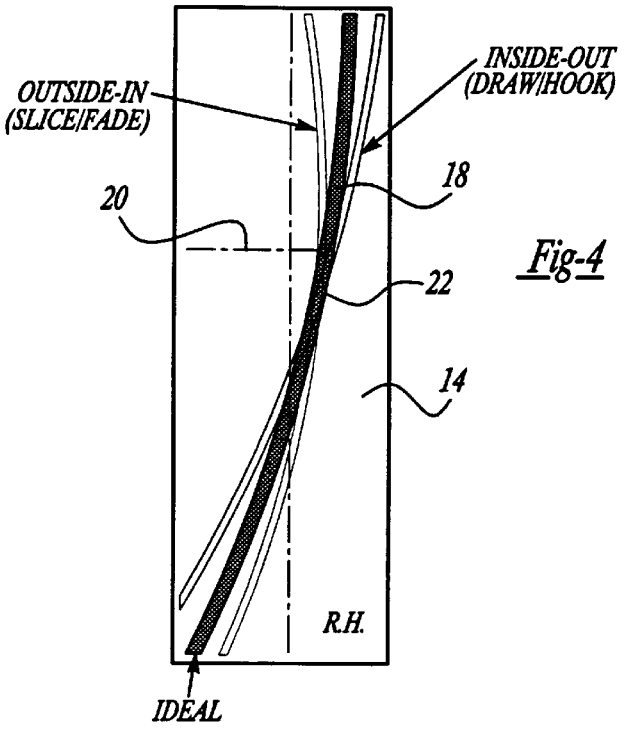
Fig-4
Fig-5
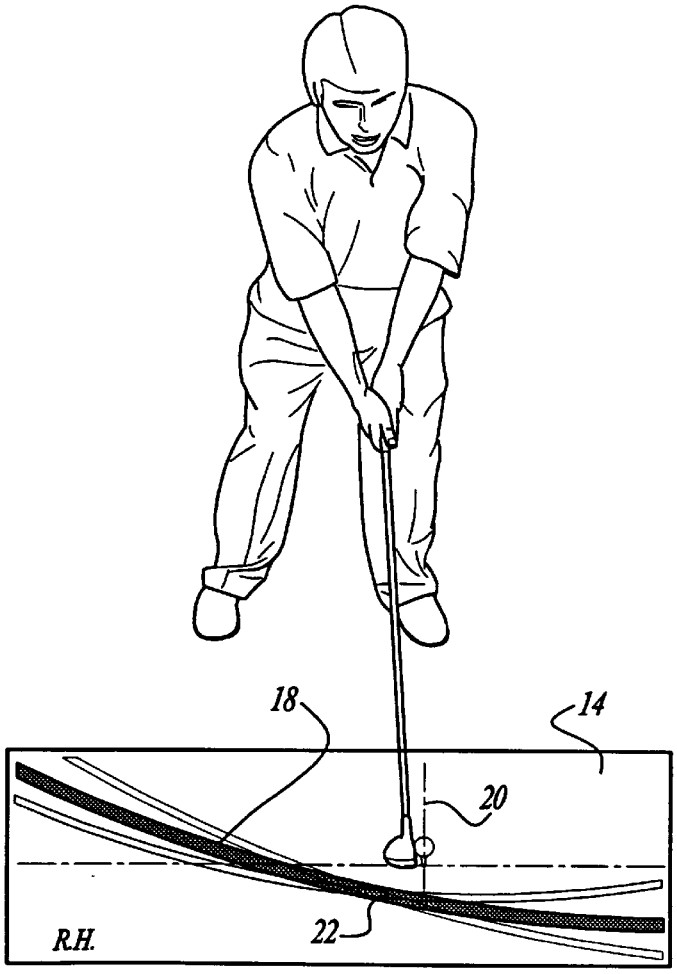

GOLF SWING TRAINING SYSTEM

BACKGROUND OF THE INVENTION

1. Field of the Invention

The present invention generally relates to a golf swing training system for assisting golfers in visualizing and learning through repetitive action whether their golf swing is following the intended swing plane. More particularly, the present invention relates to a golf swing training system employing a light source projecting from the grip end of a golf club or other similar training device which is used in association with a golf mat including graphics which are patterned to verify that the golfer is following a preferred swing plane. When properly aligned, the light source projecting from the golf club or training device should project upon the golf mat along the intended path which provides the golfer with immediate feedback as to the position of the golf club during the down swing.

2. Description of the Prior Art

As the game of golf has gained in popularity, various golf swing training devices have been proposed to assist golfers in determining the position of the golf club during the back swing and down swing. In fact, certain training devices have been proposed which specifically relate to assisting golfers in determining the position of the club when the club head is not within the field of view during periods throughout the back swing and down swing. For example, U.S. Pat. No. 4,693,479 to Maguire discloses attaching a light source to the club handle such that a light beam emits longitudinally outward from the handle thereby enabling a golfer to roughly determine the position of the club during a golf swing. However, Maguire appears to suggest that the light source employed is an incandescent bulb which is considered inadequate under most lighting conditions. U.S. Pat. Nos. 5,665,062 to Pellegrini and 5,655,973 to McPherson offer an improvement in the art in that the light source employed is disclosed as being a parallel light source, such as a laser light, for example.

While the patents to Pellegrini and McPherson are considered to be an improvement over the golf training device proposed by Maguire, the training devices are considered to be unnecessarily complicated in that the devices require insertion of an anchoring member within the axial end of the golf club shaft to accomplish attachment of the light source.

Although each of the foregoing references generally describe the concept of allowing a golfer to roughly determine the position of the golf club throughout at least portions of the back swing and/or down swing, there is no teaching or suggestion of employing an apparatus which verifies that the golf swing and, particularly the light source, is following a preferred path.

Further, there is no known golf training apparatus utilizing a light source which also serves to teach a golfer the proper hand positioning in association with various desired swing planes. When a golfer "releases" his/her hands early, they lose club head speed through the ball which results in a loss of power and distance generally. Simply following the proper swing plane is not enough since a golfer can release his/her hands early from a good swing plane on the down swing which generally would result in an undesired shot.

In view of the foregoing, the golf swing training system according to the teachings of the present invention differ significantly from the concepts and designs disclosed by the prior art, and in so doing, provide systems which not only provide an improved light emitting device which is easily retrofitted to a conventional golf club or club-like training device but also provides an apparatus for ensuring that the golfer's swing is in the proper plane and that their hands are in a proper position to release through the ball.

With the above background in mind, it is a primary object of the present invention to provide a golf swing training system which enables a golfer to visualize and feel through muscle memory whether their swing hands are properly positioned and that their swing is following the intended plane during the down swing.

It is another object of the present invention to provide a golf swing training system which is readily transportable and easy to use.

It is another object of the present invention to provide an improved light source which is retrofitable to an existing golf club or training device such that the light projects substantially along the central longitudinal axis of the shaft and thus along the intended swing plane.

It is yet another object of the present invention to provide an improved light source which generates a light beam of sufficient intensity to permit use of the device under various lighting conditions.

SUMMARY OF THE INVENTION

In view of the foregoing, the present invention relates to a golf swing training system comprising:

a laser light source attached along the grip portion of a golf club, said light source including a light beam projecting therefrom; and a mat including a graphical display depicting an intended light beam path;

whereby upon swinging said golf club, the light beam is projected upon said mat thus allowing an individual to visually verify whether the golf swing is following the intended path.

By following the intended path with the light beam, a golfer can be taught to swing the golf club along varying swing planes which in turn allows the golfer to hit the golf ball in different directions as desired. Further, through repeated use the golfer learns the proper hand positions in association with various swing planes to accomplish a desired type of shot.

BRIEF DESCRIPTION OF THE DRAWINGS

FIG. 4 is a top view of a mat including graphics for a right handed golfer in accordance with the swing training system of the present invention.

FIG. 5 is a front perspective view of a golfer positioned to utilize the swing training system of the present invention.

DETAILED DESCRIPTION OF THE PREFERRED EMBODIMENTS

Figure 1:
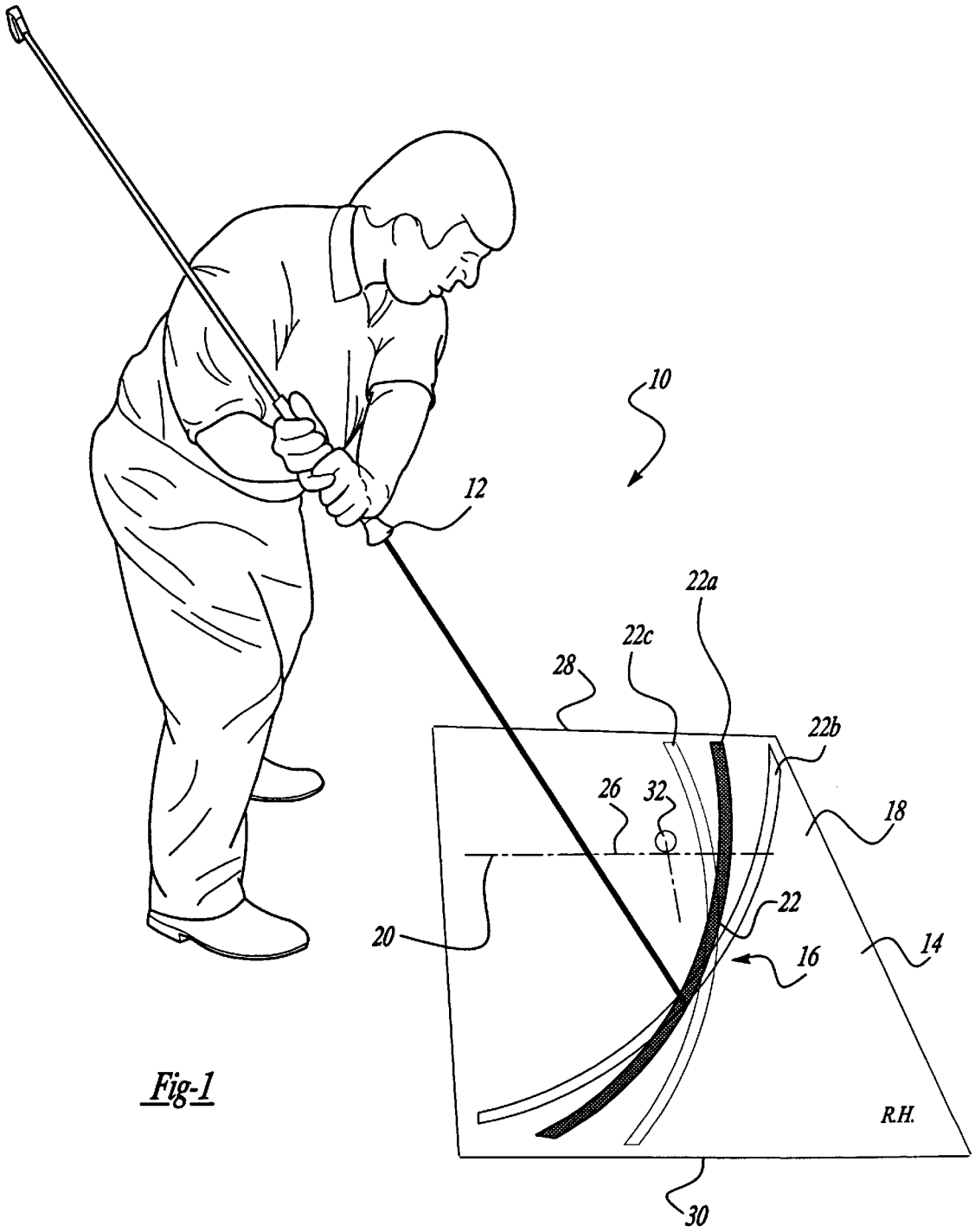
FIG. 1 is a rear perspective view of a golfer utilizing a golf swing training system in accordance with the teachings of the present invention.

Referring to FIGS. 1–6 generally, the golf swing training system 10 in accordance with the teachings of the present invention is illustrated. The golf swing verification system generally includes a light source 12 and a mat 14 having a graphical display 16 disposed on an exposed surface 18 which depicts at least one intended light beam path 22 and optionally, but preferably, an alignment demarcation 20 for properly positioning the golfer with respect to the intended light beam path.

The mat 14 is generally formed from a lightweight durable material such as artificial grass including a backing material such as rubber or plastic, by way of non-limiting example. The material utilized for the mat should be conducive to painting or screen printing, for example, in order to apply the graphical display according to one embodiment While shown to have an overall rectangular configuration, the mat 14 may be of varying shapes so long as the length dimension is at least about 3.0 feet in length and the width dimensions at least about 2.0 feet.

The alignment demarcation 20 generally includes an elongated line 26 disposed along the width of the mat closer to the leading edge 28 than the rearward edge 30. While described as optional, the alignment demarcation is important for ensuring the golfer is properly positioned with respect to the mat which in turn ensures that the light beam may follow the intended path during use. The alignment demarcation also includes a designated position 32 for a golf ball to further assist in properly positioning the golfer.

Figure 2:
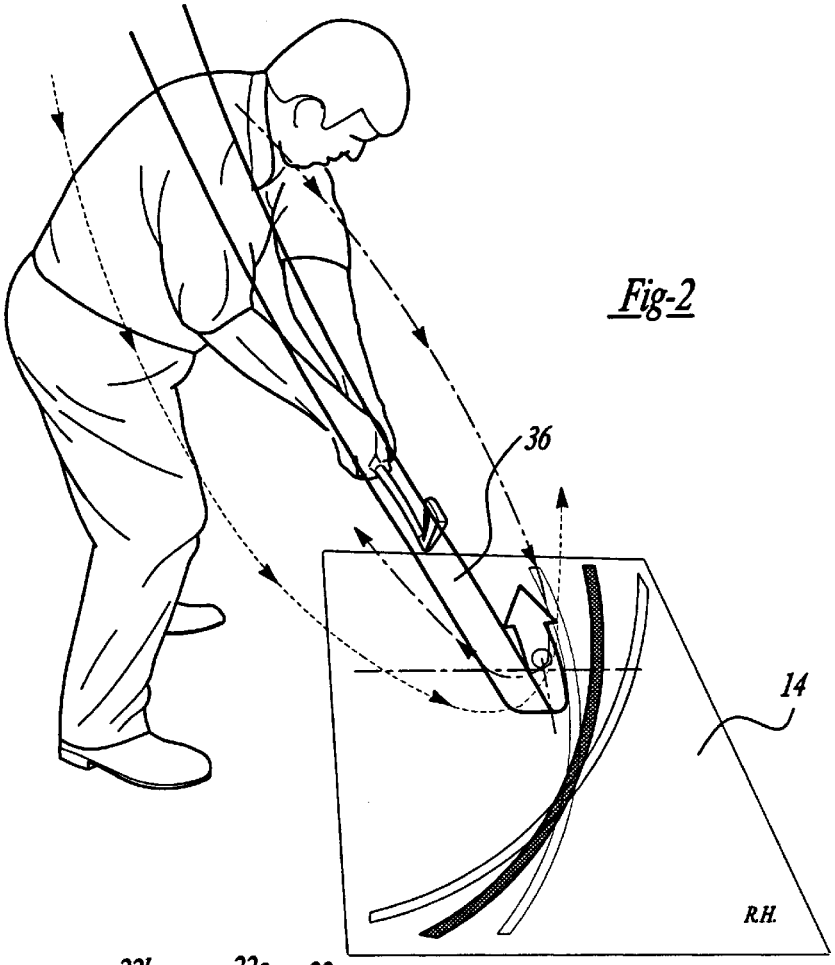
FIG. 2 is a rear perspective view illustrating the golfer's swing plane.

With regard to the so-called intended light beam path generally a plurality of arcuate light beam paths 22*a*, 22*b* and 22*c*, respectively, are provided to assist the golfer in verifying that they are following different swing planes if so desired. For example, a first path 22*a* is patterned to assist a golfer in learning the proper swing plane and hand position for hitting a golf ball with the proper spin to cause the ball to travel substantially straight. A second path 22*b*, which is closer to the golfer in the rearward direction (back swing) and further from the golfer in the forward direction (down swing) as compared to path 22*a* is patterned to assist a golfer in learning to swing the golf club along a plane in order to draw the golf ball, i.e., hit the golf ball with the proper type of spin to cause the ball to move from right to left as it approaches the target area. A third path 22*c*, which starts farther from the golfer in the rearward direction (back swing) and closer to the golfer in the forward direction (down swing) as compared to path 22*a* assists the golfer in learning to swing the golf club along a plane which allows the golfer to fade the golf ball, i.e., hit the golf ball with the proper type of spin to cause the ball to move from left to right as it approaches the target area. Each path is generally arcuate or slightly curved to mimic the natural tendencies of a golfer's swing plane. Advancement of the golf club along a swing plane is illustrated in FIG. 2 and designated by reference numeral 36.

In addition to teaching the golfer the desired swing plane to carry out a particular type of shot, the golf swing training system also serves to teach the hand positioning required to carry out the desired shot. The light beam paths 22 are thus positioned so that a golfer's hands are required to be in a particular position throughout the swing in order for the light beam to be projected upon the desired path.

Figure 7:
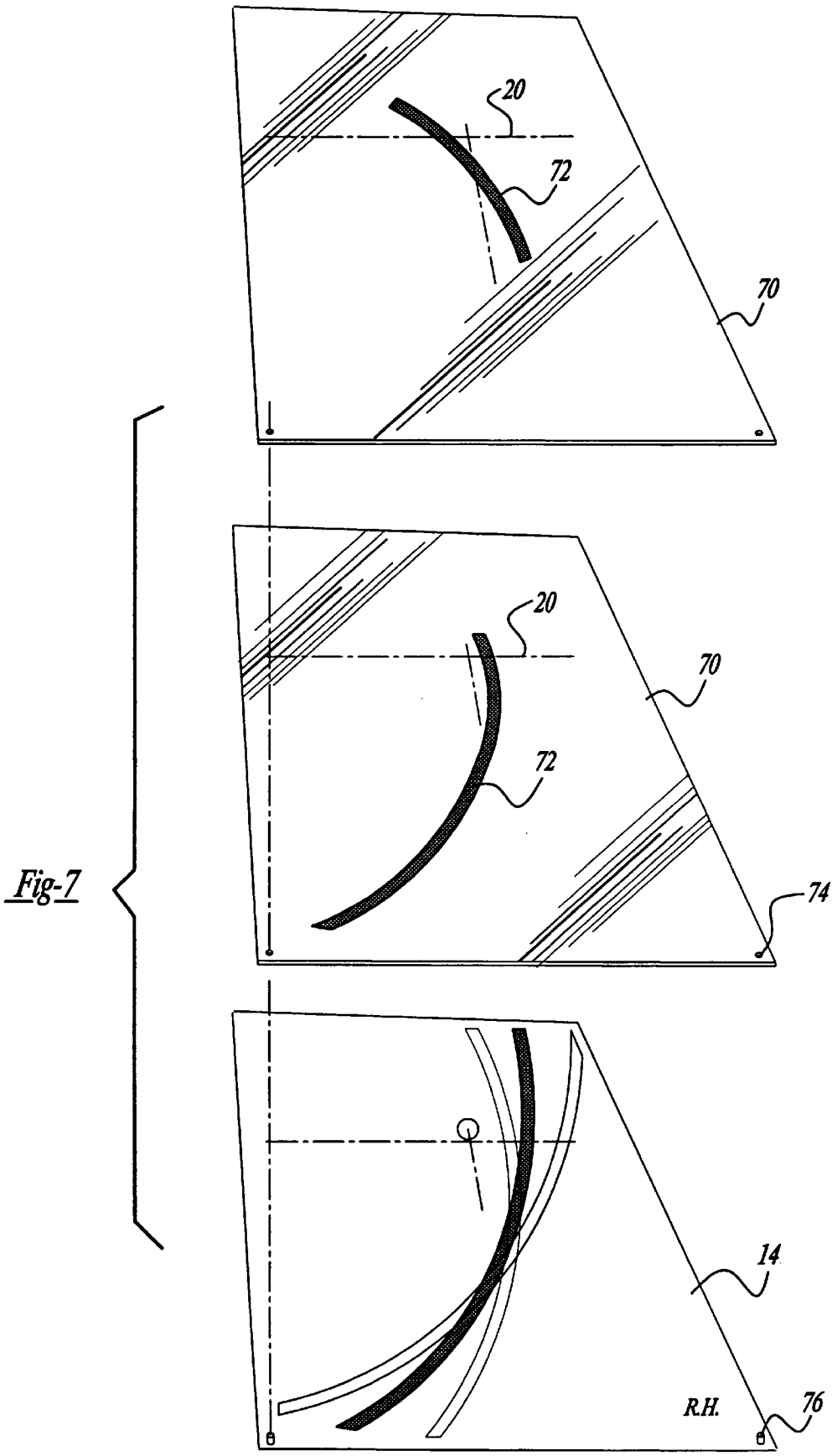
FIG. 7 is a disassembled rear perspective view of overlays including light beam path graphics.

Referring to FIG. 7, there is shown a disassembled perspective view of a plurality of relatively transparent overlays 70 including a predetermined graphical display 72 which is generally used in association with the mat 14. For example, the overlay may include graphics which would teach a golfer a specialized shot such as a green side bunker shot. The overlay may be a single sheet or may include multiple sheets fastened to the mat along an end by mating the apertures 74 with the fasteners 76 extending upwardly from the mat 14 at one end. As should be understood based on the foregoing description, the overlay can be used exclusive of the mat if so desired.

Figure 3:
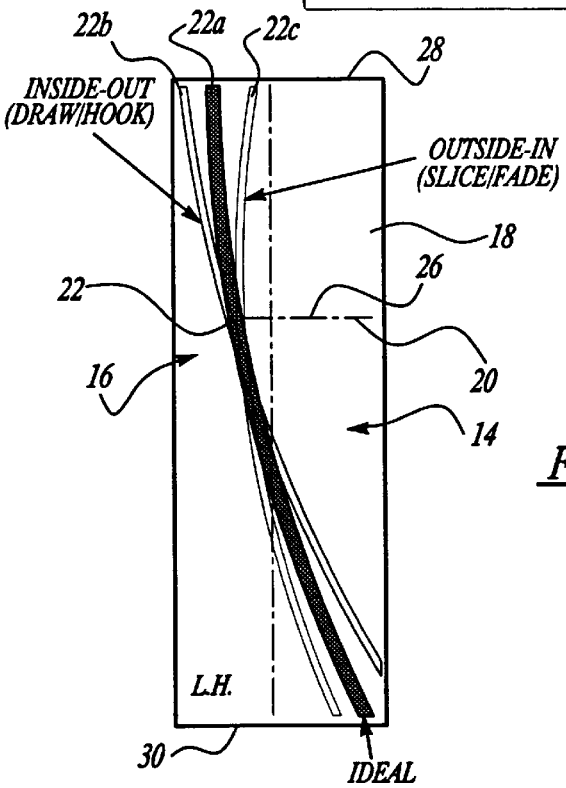
FIG. 3 is a top view of a mat including graphics for a left handed golfer in accordance with the swing training system of the present invention.
Figure 6:
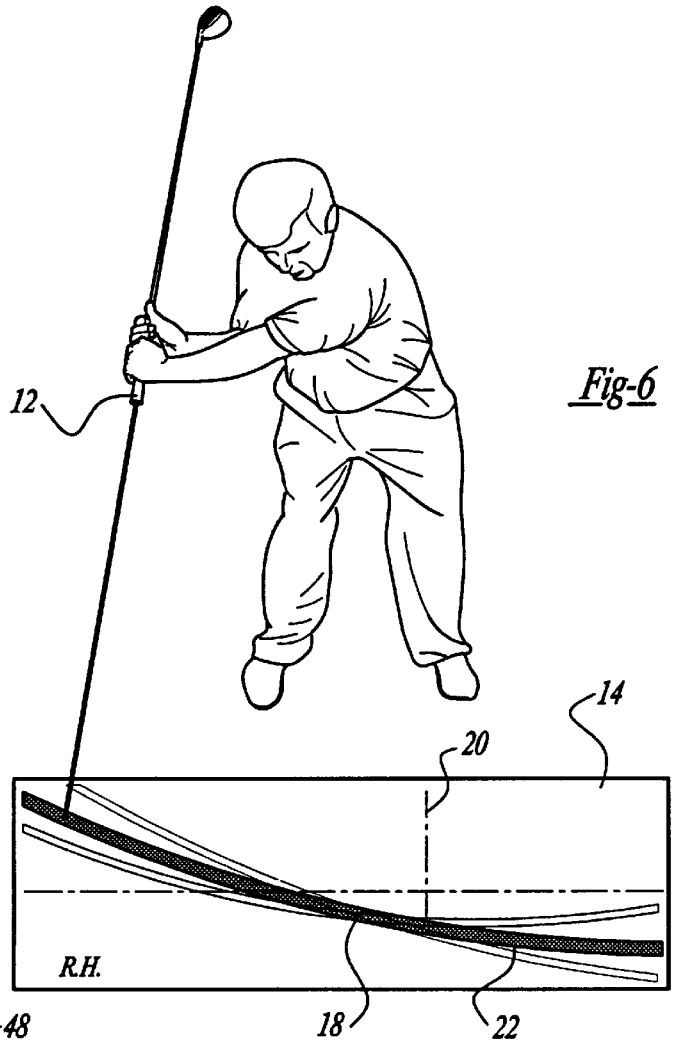
FIG. 6 is a front perspective view illustrating a light beam projected upon an intended path of the golf swing training system.

The golf swing training system of the present invention can be utilized by both right and left handed golfers thus, for left handed golfers, the mat 14 as illustrated if FIG. 3, includes a similar graphical display 16 disposed substantially on the opposite side of the exposed surface 18. Optionally, a universal application (not shown) is contemplated wherein the graphical display for both right and left handed golfers is included on the same exposed surface. Likewise, it is contemplated that right and left handed graphics could be provided on opposite sides of the mat thereby allowing the same to be used by simply flipping the mat over so that the proper side is exposed.

Figure 8:
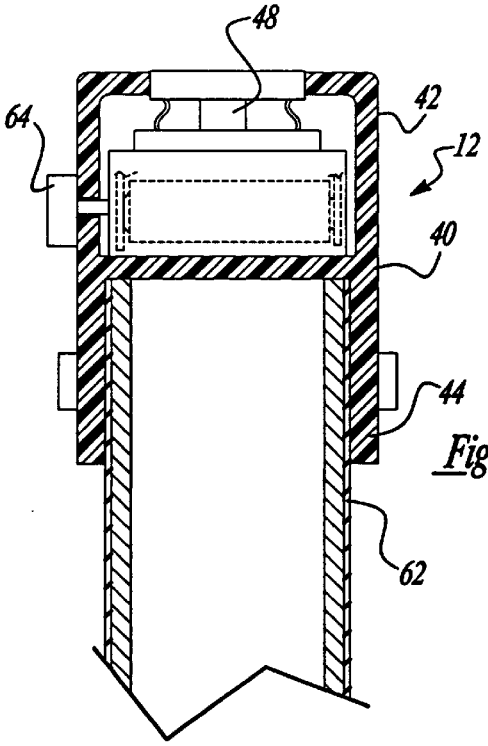
FIG. 8 is a sectional view illustrating a light source useful in association with the golf swing training system of the present invention.
Figure 9:
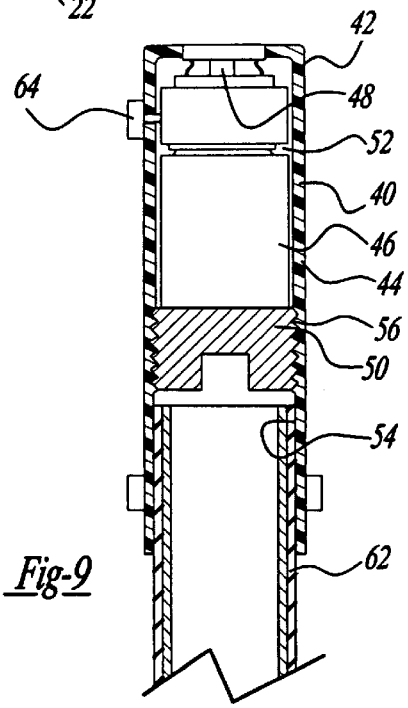
FIG. 9 is a sectional view of an alternative light source.

Referring to FIGS. 8 and 9, the present invention is additionally directed to an improved light source apparatus which can be used alone or in association with the above described patterned mat, for example. The light source 12 includes an elastomeric sleeve 40 including a first section 42 which houses a battery 46 and a laser light 48 which generates the light beam preferably projecting along the central longitudinal axis of the club shaft which is projected upon the mat. The second section 44 of the sleeve is disposable over the golf club grip 62. While the light source is specifically described herein as being attachable to a golf club, it is important to note that the phrases "golf club" and "golf club grip" are intended to encompass golf club training devices as well.

As illustrated in FIG. 7, the sleeve 40 may be molded to permanently retain the lighting components or alternatively, as shown in FIG. 8, may include a selectively detachable plug 50 disposed within the cavity 52 of the sleeve such that the lighting components can be replaced if necessary. The plug 50 is preferably removably fastened to the inner wall 54 of the sleeve via a mechanical attachment such as threads 56 or may optionally be press-fit into position against the base of the battery 46 to assist in retaining the battery and light in electrical contact.

The diameter of the sleeve 40, particularly along the second section 44, may vary depending on the size of club grip over which the light source is disposed upon attachment. For example, the diameter may be sufficiently large to fit an oversized grip and may be reduced to fit a smaller grip by tightening a clamp 60.

Once applied over the golf club grip 62, the light source 12 may be activated by moving a switch 64 to the "on" position and deactivated by returning the switch to the "off" position.

While it will be apparent that the preferred embodiments of the invention disclosed are well calculated to fulfill the objects stated, it will be appreciated that the invention is susceptible to modification, variation and change without departing from the spirit thereof.

What is claimed is:

1. A golf swing training system:

a light source attached along the grip end of a golf club, said light source including a light beam projecting therefrom; and a mat including a graphical display depicting an arcuate light beam path;

whereby upon swinging said golf club, the light beam projecting from the grip end of said golf club is projected upon said mat such that the light beam follows said arcuate path thus allowing an individual to verify whether the golf swing is in a proper plane.

2. The golf swing training system of claim 1 wherein said graphical display includes an arcuate light beam path patterned to teach a golfer to swing the club along a plane in order to hit a golf ball substantially straight.

3. The golf swing training system of claim 1 wherein said graphical display includes an arcuate light beam path patterned to teach a golfer to swing the club along a plane in order to hit a golf ball with a draw.

4. The golf swing training system of claim 1 wherein said graphical display includes an arcuate light beam path patterned to teach a golfer to swing the club along a plane in order to hit a golf ball with a fade.

5. The golf swing training system of claim 1 wherein said graphical display includes a plurality of arcuate light beam paths, said plurality of paths including a first light beam path patterned to teach a golfer to swing the club along a plane in order to hit a golf ball substantially straight and a second light beam path patterned to teach a golfer to swing the club along a plane in order to either draw or fade a golf ball.

6. The golf swing training system of claim 1 wherein said mat includes an alignment demarcation.

7. The golf swing training system of claim 1 wherein said light source comprises:

a substantially hollow sleeve including a first section containing a battery and a laser light and a second section which is disposed over a golf club grip upon attachment.

8. The golf swing training system of claim 1 further comprising an overlay including a graphical display depicting an alternate light beam path, said overlay being positioned over said mat to change the intended light beam path.

9. The golf swing training system of claim 1 wherein a golfer is taught both a desired swing plane and the proper hand positioning necessary to release their hands at the time of impact with a golf ball.

10. The golf swing training system of claim 1 further comprising an overlay including a graphical display depicting an alternate light beam path, said overlay being positioned over said mat to change the intended light beam path.

11. A golf swing training system comprising:

a light source attached along the grip end of a golf club, said light source including a light beam projecting therefrom; and a mat including at least one overlay having a graphical display depicting an intended light beam path;

whereby upon swinging said golf club, the light beam projecting from the grip end of said golf club is projected upon said overlay such that the light beam follows said intended light beam path thus allowing an individual to verify whether the golf swing is in a proper plane to accomplish a particular golf shot.

12. The golf swing training system of claim 11 wherein said graphical display of said overlay includes a plurality of light beam paths, said plurality of paths including a first light beam path patterned to teach a golfer to swing the club along a plane in order to hit a golf ball substantially straight and a second light beam path patterned to teach a golfer to swing the club along a plane in order to either draw or fade a golf ball.

13. The golf swing training system of claim 11 wherein said mat includes an alignment demarcation.

14. The golf swing training system of claim 11 wherein said light source comprises:

a substantially hollow sleeve including a first section containing a battery and a laser light and a second section which is disposed over a golf club grip upon attachment.

15. The golf swing training system of claim 11 wherein a golfer is taught both a desired swing plane and the proper hand positioning necessary to release their hands at the time of impact with a golf ball.

16. The golf swing training system of claim 11 wherein said overlay is substantially transparent.

17. The golf swing training system of claim 11 wherein said mat includes a graphical display depicting an intended light beam path.

* * * * *